US005496593A

United States Patent [19]

Tsai et al.

[11] Patent Number: 5,496,593

[45] Date of Patent: Mar. 5, 1996

[54] PROCESS FOR PRODUCING A NITROGEN-ALLOYED STAINLESS STEEL LAYER ON STEEL

[75] Inventors: Wen-Ta Tsai, Tainan; Chong-Cheng Huang, Yung-Kang; Ju-Tung Lee, Tainan, all of Taiwan

[73] Assignee: National Science Council, Taipei, Taiwan

[21] Appl. No.: 333,037

[22] Filed: Nov. 1, 1994

[51] Int. Cl.[6] ..... B05D 3/06

[52] U.S. Cl. ..... 427/556; 427/190; 427/191; 427/198; 427/201; 427/228; 427/275; 427/287; 427/292; 427/307; 427/383.7; 427/597

[58] Field of Search ..... 427/554, 555, 427/556, 559, 190, 191, 198, 201, 228, 383.3, 383.7, 307, 292, 287, 275, 597

*Primary Examiner*—Bernard Pianalto

*Attorney, Agent, or Firm*—Lackenbach Siegel Marzullo Aronson & Greenspan

[57] ABSTRACT

A process for producing a nitrogen-alloyed stainless steel layer on steel by applying nitride containing mixed metal powder or stainless powder to the steel surface, and thereafter treating the steel with laser beams.

12 Claims, 10 Drawing Sheets

PROCESS FOR PRODUCING A NITROGEN-ALLOYED STAINLESS STEEL LAYER ON STEEL

BACKGROUND OF THE INVENTION

The present invention relates to a process for producing a nitrogen-alloyed stainless steel layer on steel by laser surface alloying, and in particular to a process for producing a nitrogen-alloyed stainless steel layer on steel by applying mixed metal powders containing nitride to the steel, and thereafter treating the steel with laser beams.

Due to their superior mechanical strength and corrosion resistance, in particular pitting corrosion resistance, nitrogen-containing stainless steels have drawn the attention of many researchers. Conventionally, nitrogen containing stainless steels are manufactured by, for example, pressurized induction melting, plasma remelting, hot isostatic pressure melting and pressurized electroslag refining methods. However, these methods all involve high temperature and high pressure processes, and therefore the process control is difficult.

Ionic nitriding and plasma nitriding methods are commercially utilized methods for forming nitride layers on the surface of steels to improve the abrasion and corrosion resistance thereof. However, these methods must be applied in a vacuum ambient, and consume an undesirable amount of time and energy.

Steels usually have low corrosion resistance. If a nitrogen containing stainless steel layer can be formed on steels, topical corrosion, such as pitting corrosion and crevice corrosion resistance can be improved. Using the Laser Surface Alloying(LSA) method to form a nitrogen containing stainless steel layer on the surface of steels, from the view of saving energy and reducing production costs, should be the best method for improving the corrosion resistance of steels. Because by this method, not only can the moderate strength and toughness of the steel material be retained, but the corrosion resistance can also be improved.

SUMMARY OF THE INVENTION

It is therefore an object of the invention to provide a process for producing a nitrogen-alloyed stainless steel layer on steel to eliminate the above-mentioned disadvantages.

According to the process of the invention, the surface of the steel is first cleaned by mechanical means, and then mixed metal powders containing nitride are applied to the surface, followed by scanning the surface of the steel with laser beams. The heat generated by the scanning laser beams melts the mixed metal powders, and decomposes the nitride into nitrogen and the other element forming the nitride, which then dissolve into the melted metal powders, thereby forming a stainless steel layer on the steel.

According to an aspect of the process of the invention, the amount of the nitride is 1 to 3 percent by weight of the total amount of the mixed metal powders.

According to another aspect of the invention, the laser beam scanning is conducted in a shielding gas.

BRIEF DESCRIPTION OF THE DRAWINGS

The foregoing features of this invention, as well as the invention itself, may be fully understood from the following detailed description, examples and drawings, in which.

DETAILED DESCRIPTION OF THE INVENTION

Steels including but not limited to carbon steel, alloyed steel, and special alloyed steel are suitable for the laser surface alloying treatment of the invention.

Nitride powders, such as silicon nitride, titanium nitride, aluminum nitride, boron nitride, chromium nitride, and tungsten nitride are used in the process of the invention, and the amount used is 1 to 3 percent by weight of the mixed metal powders.

The metal powders include but are not limited to iron powder, chromium powder, molybdenum powder, nickel powder and stainless powder. A mixed powder or a stainless powder is used in the process of the invention. For example, a mixture of iron powder and chromium powder, a mixture of iron powder, chromium powder and nickel powder, and a mixture of iron powder, chromium powder, and molybdenum powder is preferably be used in the process of the invention. Note that the mixed metal powder must contain at least iron powder and chromium powder so that upon being treated by laser beams, the mixed powder can form a stainless steel layer. By varying the alloying metal powder and the amount used, the texture of the formed stainless steel layer can be adjusted, for example, a ferritic or a ferritic and austenitic dual phase nitrogen-alloyed stainless steel layer can be formed on the surface of the steel.

The nitride containing mixed metal powder is provided on the surface of the steel by either uniformly distributing thereon or preplacing in a groove formed in the steel. If the mixed metal powder is to be distributed directly on the steel, the thickness of the distributed powder should be in the range of 1 to 1.5 mm. If a groove is used to receive the mixed metal powder, the groove should have an area substantially of the same size of the surface to be treated, and the depth should preferably be between 1 and 1.5 mm. The groove can be formed, for example by machining. Note that before the mixed metal powder is applied to the steel for treatment, the surface of the steel must be mechanically cleaned to remove any oxides and impurities thereon. The cleaning can be performed, for example, by sandblasting.

The scanning process can be operated on a circulating cooled computer-numeric-controlled X-Y working plate in a shielding gas, for example an argon or nitrogen gas. The workpiece is scanned by a laser beam, for example a $CO_2$ laser beam with a power output between 4 kW and 4.5 kW, a power density between 9 and 10 kW/cm$^2$ at a scanning speed of 60 to 75 cm/min. The workpiece can be treated by single pass or multiple passes of laser beams. The thickness of the nitrogen-alloyed stainless steel layer on the steel is adjusted by varying the power output, or power density and the scanning speed.

The following examples are intended to demonstrate the invention more fully without acting as a limitation upon its scope, since numerous modifications and variations will be apparent to those skilled in this art.

EXAMPLE 1

Figure 1A:
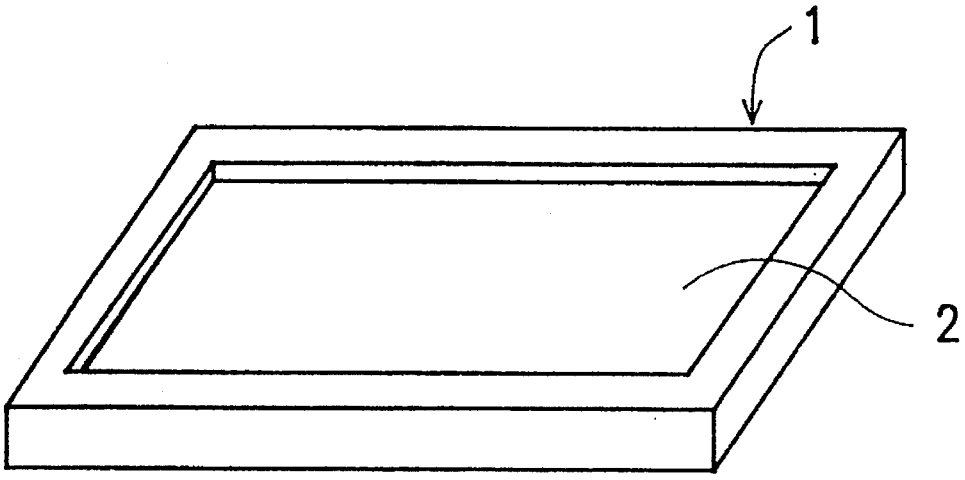
FIG. 1*a* is a diagram showing the steel specimen to be treated by the process of Example 1.
Figure 1B:
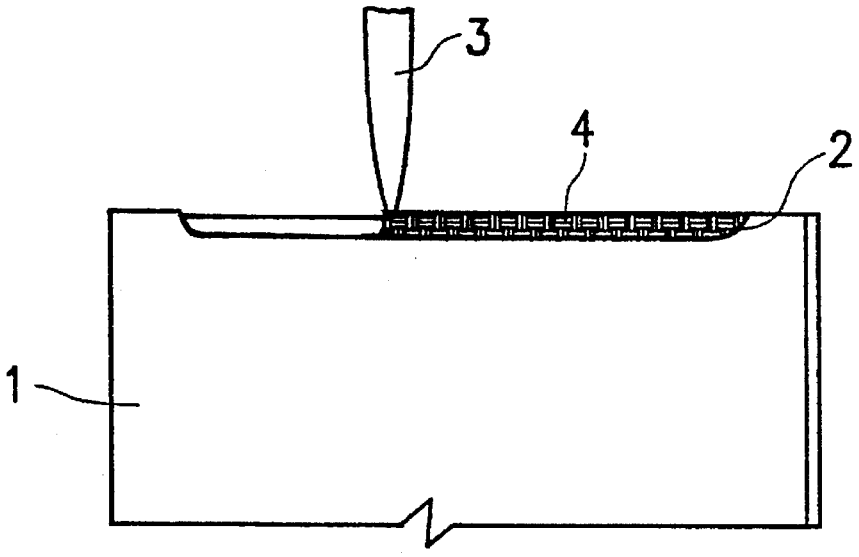
FIG. 1*b* is a schematic diagram showing a $CO_2$ laser beam scanning the steel specimen of FIG. 1*a* according to the process of Example 1.

In this example, an AISI 1020 carbon steel 1 having the shape as depicted in FIG. 1*a* was used as a steel specimen for treatment. A groove 2 of 1.0 mm deep, 40 mm wide and 100 mm long was formed on the surface of the AISI 1020 carbon steel. The mixed metal powder used contained 1.5 wt % of silicon nitride powder having an average particle size of 0.6 μm, 68.5 wt % of iron powder having an average particle size of 100 μm, and 30 wt % of chromium powder having an average particle size of 10 μm. The surface of the steel was subjected to the scanning of a $CO_2$ laser beam having a power output of 4 kW, a power density of 10 kW/cm$^2$ with a scanning speed of 60 cm/min, single pass. The argon flow rate was 12 liter/min. A schematic diagram showing the above laser surface alloying is shown in FIG. 1*b*, in which 3 is the laser beam, 4 is the mixed metal powder which is preplaced in the groove 2 of carbon steel 1. The composition of the obtained nitrogen-alloyed stainless steel layer is summarized in Table 1 below.

EXAMPLE 2

The same procedures and materials as in Example 1 were used, except that the steel substrate was subjected to multiple passes of laser beams with 50% beam overlap. The composition of the obtained nitrogen-alloyed stainless steel layer is summarized in Table 1 below.

EXAMPLE 3

In this example, AISI 1020 carbon steel was used as steel substrate to be treated. A groove of 1.5 mm thick was formed on the surface of the AISI 1020 carbon steel. The mixed metal powder used contained 2 wt % of silicon nitride powder, 68 wt % of iron powder, and 30 wt % of chromium powder. The surface of the steel was subjected to the scanning of a $CO_2$ laser beam having a power output of 4.5 kW, a power density of 9 kW/cm$^2$ with a scanning speed of 75 cm/min, single pass. The argon flow rate was 12 liter/min. The composition of the obtained nitrogen-alloyed stainless steel layer is summarized in Table 1 below.

EXAMPLE 4

The same procedures and materials as in Example 3 were used, except that the mixed metal powder contained 2 wt % of silicon nitride, 5 wt % of molybdenum powder, 63 wt % of iron powder and 30 wt % of chromium powder. The composition of the obtained nitrogen-alloyed stainless steel layer is summarized in Table 1 below.

EXAMPLE 5

The same procedures and materials as in Example 3 were used, except that the mixed metal powder contained 2 wt % of silicon nitride, 58 wt % of iron powder and 40 wt % of chromium powder. The composition of the obtained nitrogen-alloyed stainless steel layer is summarized in Table 1 below.

EXAMPLE 6

The same procedures and materials as in Example 3 were used, except that the mixed metal powder contained 2 wt % of silicon nitride, 48 wt % of iron powder and 50 wt % of chromium powder. The composition of the obtained nitrogen-alloyed stainless steel layer is summarized in Table 1 below.

EXAMPLE 7

The same procedures and materials as in Example 6 were used, except that the mixed metal powder contained 2 wt % of silicon nitride, 48 wt % of iron powder, 25 wt % of chromium powder and 25 wt % of nickel powder. The composition of the obtained nitrogen-alloyed stainless steel layer is summarized in Table 1 below.

EXAMPLE 8

The same procedures and materials as in Example 6 were used, except that the mixed metal powder contained 2 wt % of silicon nitride, 58 wt % of iron powder, 25 wt % of chromium powder and 15 wt % of nickel powder. The composition of the obtained nitrogen-alloyed stainless steel layer is summarized in Table 1 below.

EXAMPLE 9

The same procedures and materials as in Example 6 were used, except that the mixed metal powder contained 2 wt % of silicon nitride, 50 wt % of iron powder, 25 wt % of chromium powder, 8 wt % of molybdenum powder, and 15 wt % of nickel powder. The composition of the obtained nitrogen-alloyed stainless steel layer is summarized in Table 1 below.

EXAMPLE 10

The same procedures and materials as in Example 6 were used, except that the mixed metal powder contained 3 wt % of silicon nitride, 62 wt % of iron powder, and 35 wt % of chromium powder. The composition of the obtained nitrogen-alloyed stainless steel layer is summarized in Table 1 below.

TABLE 1

| Exp. No. | Composition of Nitrogen-alloyed Stainless Steel Layer | | | | | | Amount of Austenite |
|---|---|---|---|---|---|---|---|
| | Fe | Cr | Ni | Mo | Si | N | (%) |
| 1 | 73.0 | 25.7 | 0 | 0 | 0.92 | 0.46 | 45 |
| 2 | 78.7 | 20.4 | 0 | 0 | 0.53 | 0.35 | 45 |
| 3 | 71.2 | 27.3 | 0 | 0 | 0.94 | 0.52 | 30 |
| 4 | 68.6 | 25.8 | 0 | 4.3 | 0.83 | 0.50 | 20 |
| 5 | 60.2 | 37.3 | 0 | 0 | 0.98 | 0.56 | <5 |
| 6 | 51.1 | 47.4 | 0 | 0 | 0.90 | 0.61 | <3 |
| 7 | 54.3 | 22.5 | 21.9 | 0 | 0.95 | 0.38 | 85 |
| 8 | 64.7 | 21.7 | 12.2 | 0 | 0.98 | 0.40 | 75 |
| 9 | 58.6 | 21.4 | 12.3 | 6.2 | 1.02 | 0.48 | 70 |
| 10 | 63.6 | 34.5 | 0 | 0 | 1.3 | 0.57 | 15 |

Figure 2:
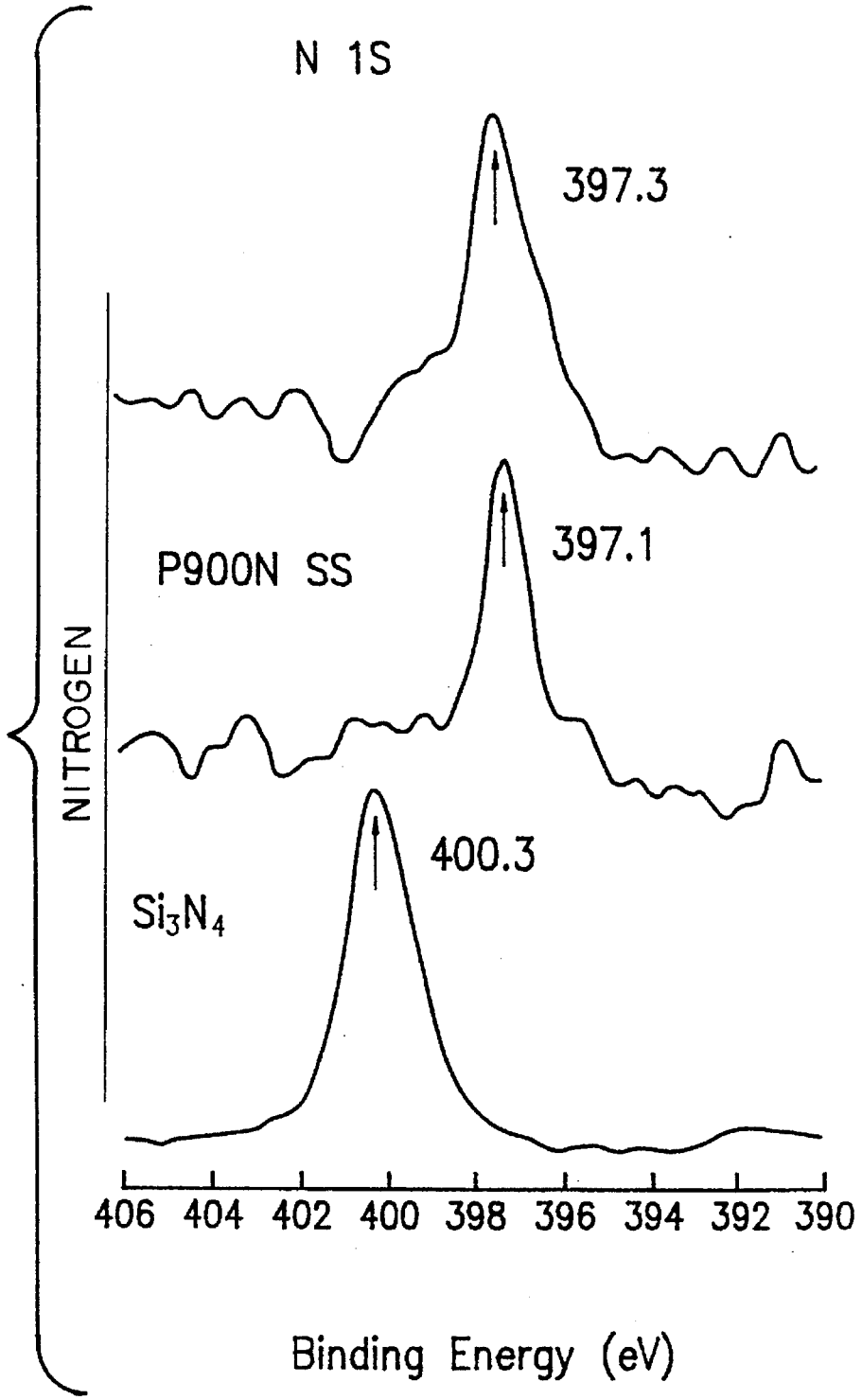
FIG. 2 is a diagram depicting the binding energy of the nitrogen in the stainless steel layer formed in Example 2, the nitrogen of silicon nitride used in Example 2, and the nitrogen in P9000N stainless steel.

The binding energy of the nitrogen in the obtained stainless steel layer in Example 2, the nitrogen of silicon nitride ($Si_3N_4$) used in Example 2, and the nitrogen of a commercial available P900N stainless steel (high nitrogen contained, 0.9 Wt %) were measured by XPS (X-ray Photoelectron Spectrum, xps) analysis and the results were shown in FIG. 2. As shown in FIG. 2, $N_{1s}$ XPS spectrum of $Si_3N_4$ has a peak at 400.3 eV, and $N_{1s}$ XPS spectrum of P900N stainless steel has a peak at 397.1 eV. This means that the nitrogen solid soluted in P900N stainless steel, the binding energy of nitrogen in this stainless steel closes to 397.1 eV. It is shown from the binding energy diagram that $N_{1s}$ XPS spectrum of the stainless steel layer of Example 2 has a peak at 397.3 eV, which is almost the same as that of P900N, indicating the obtained stainless steel layer also has the same level of nitrogen content therein.

Figure 3:
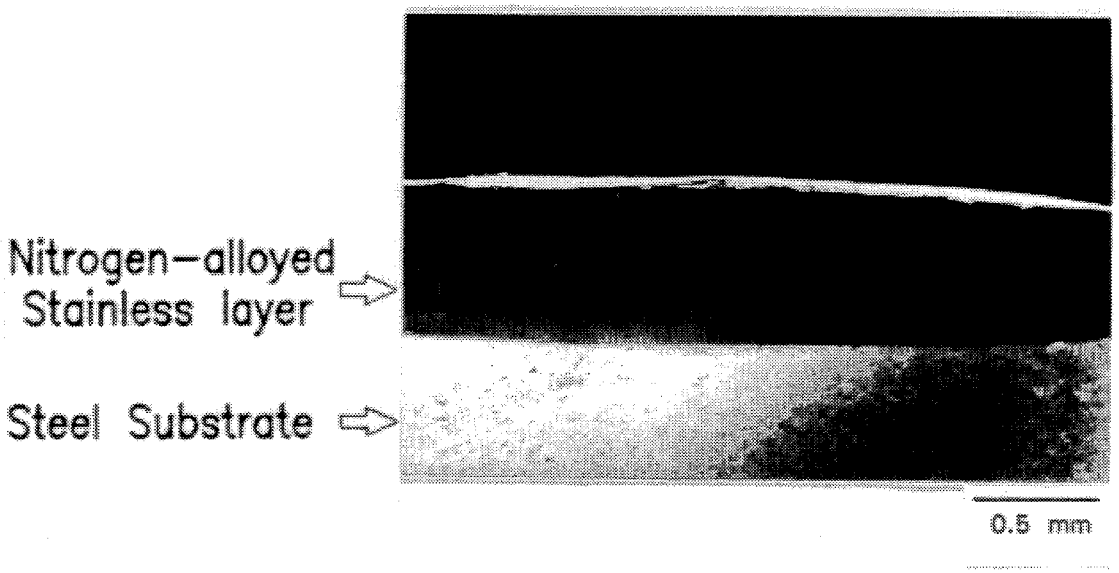
FIG. 3 is a sectional metallographic diagram of the stainless steel layer obtained in Example 2.
Figure 4:
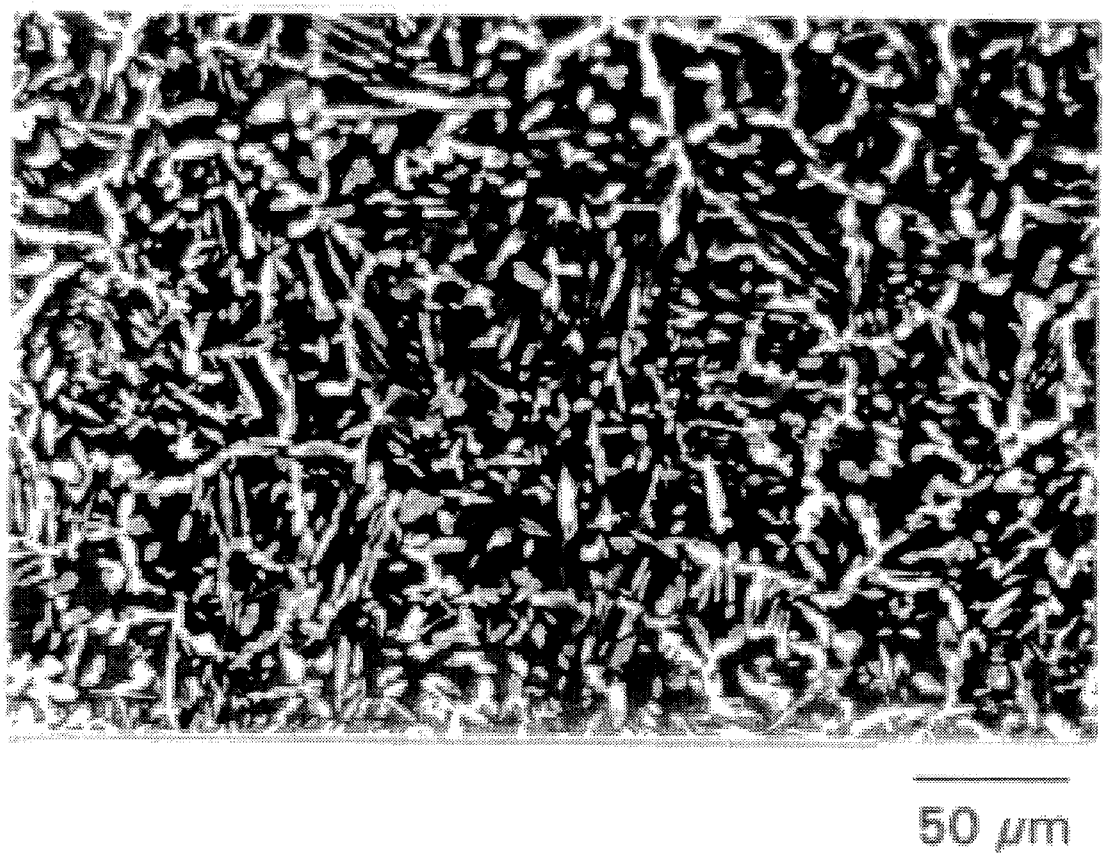
FIG. 4 is plane metallographic diagram of the stainless steel layer obtained in Example 2.
Figure 5:
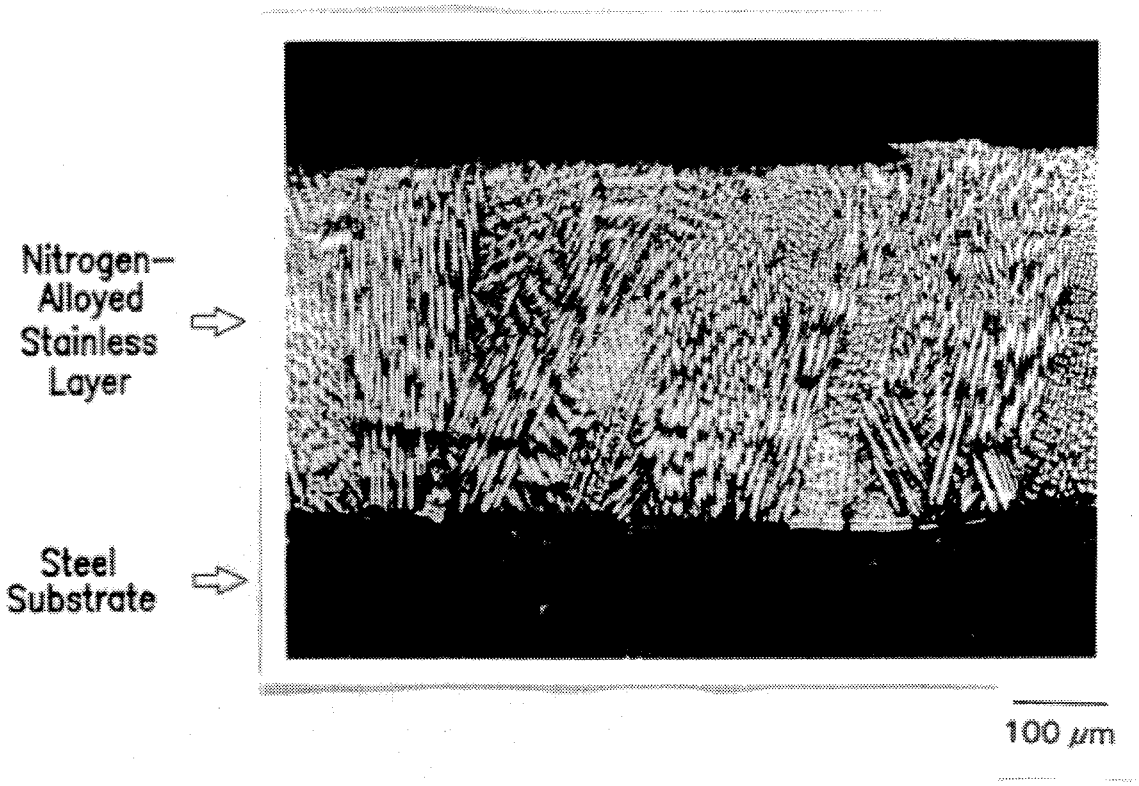
FIG. 5 is a sectional metallographic diagram of the stainless steel layer obtained in Example 7.
Figure 6:
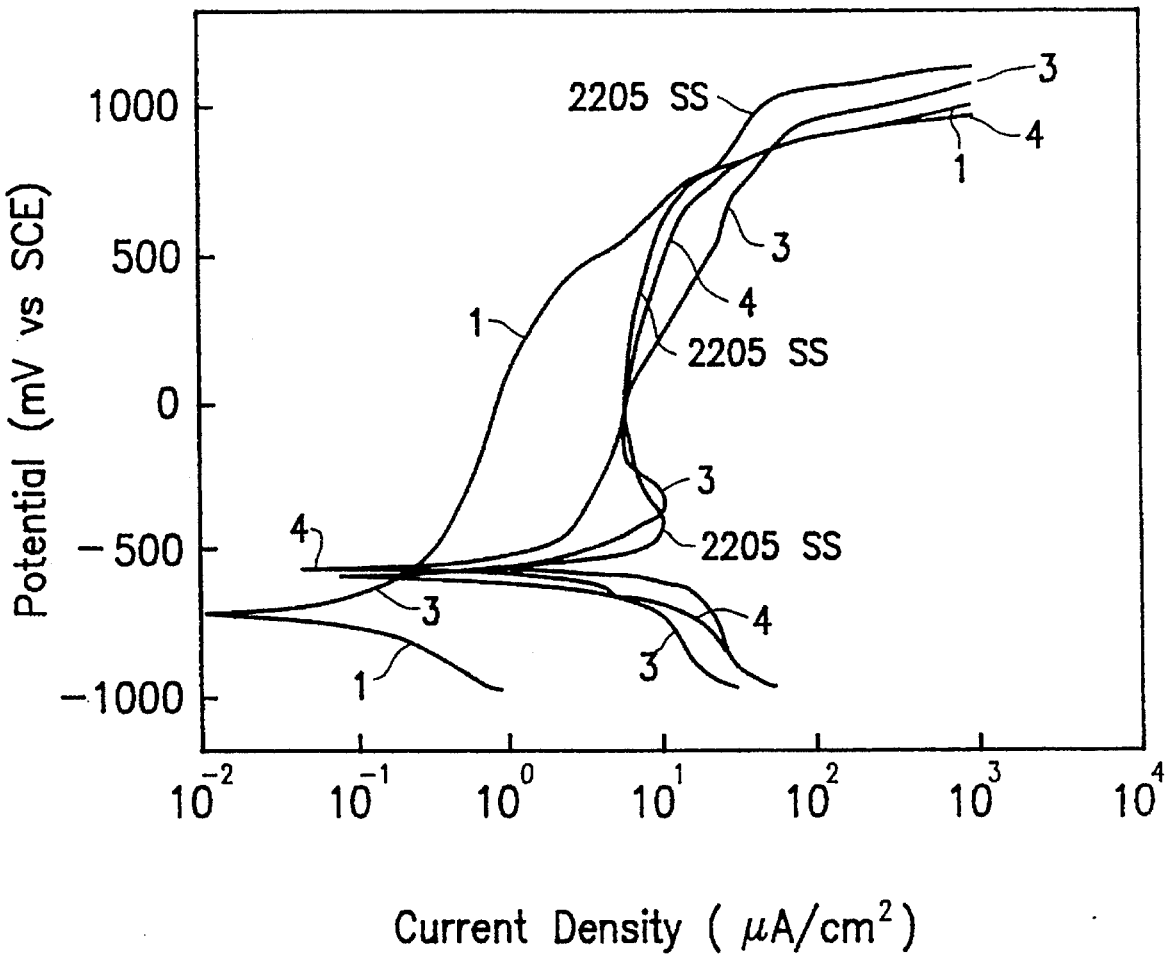
FIG. 6 is a diagram showing the potentiodynamic polarization curves of the nitrogen-alloyed stainless steel layers obtained in Examples 1,3, 4 and SAF2205 ferritic and austenitic dual phase stainless steel in deaerated neutral 3.5 wt % NaCl solution.
Figure 7:
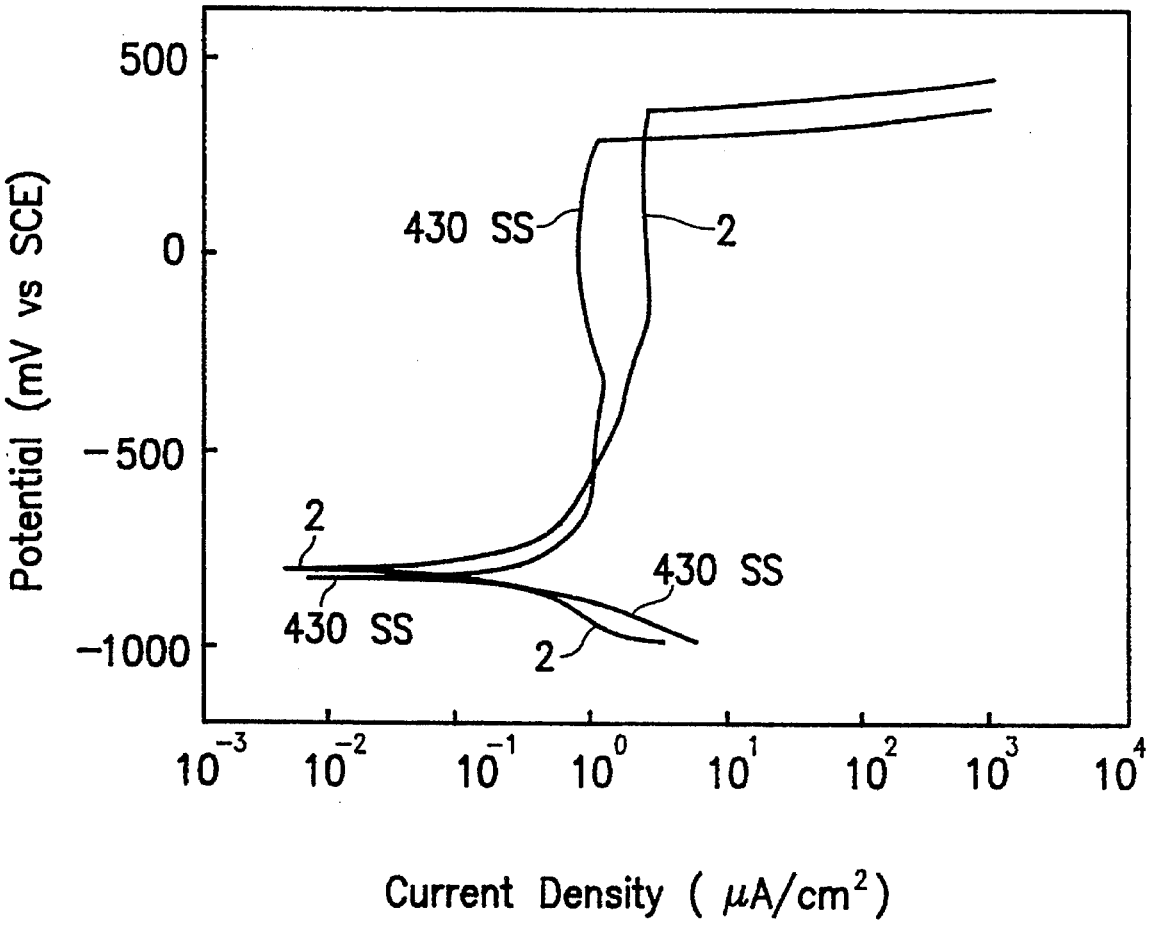
FIG. 7 is a diagram showing the potentiodynamic polarization curves of the nitrogen-alloyed stainless steel layers obtained in Example 2 and ferritic 430 stainless steel in deaerated neutral 3.5 wt % NaCl solution.
Figure 8:
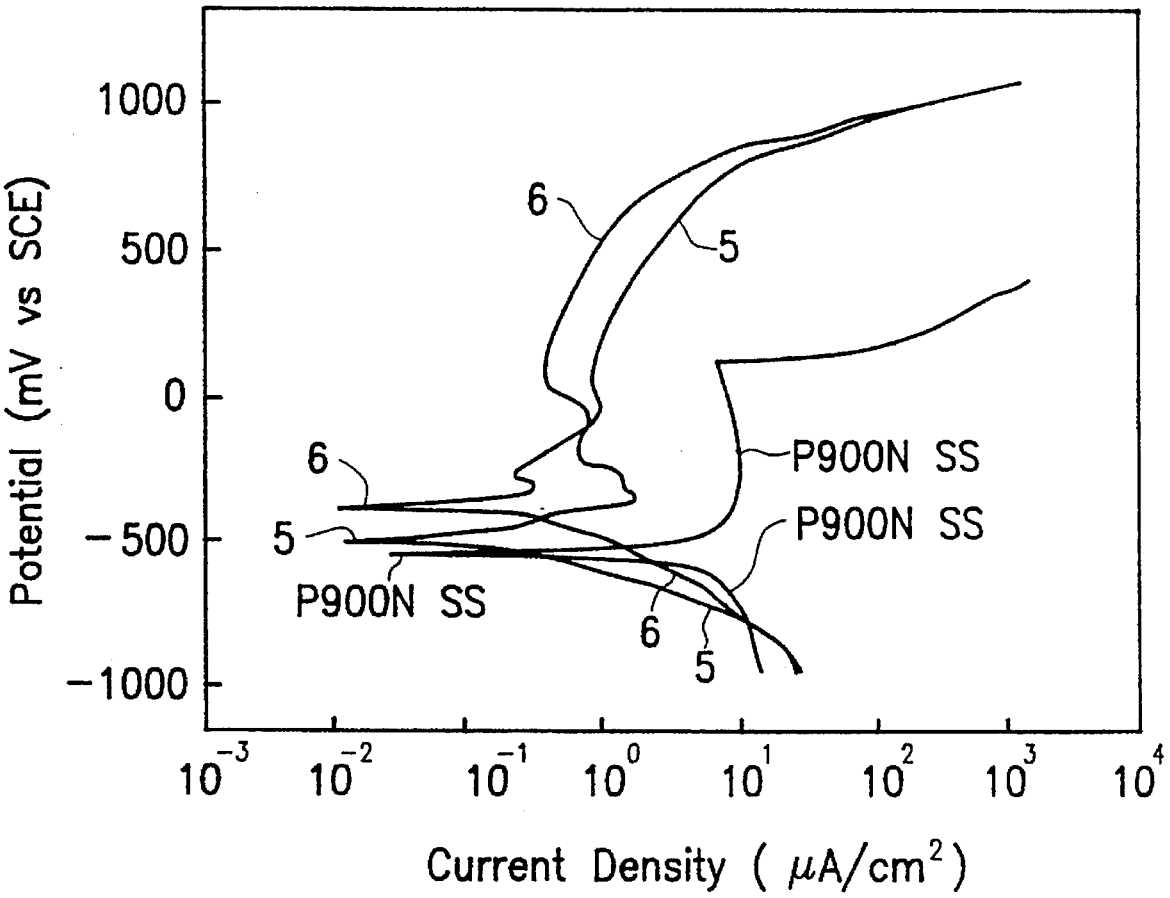
FIG. 8 is a diagram showing the potentiodynamic polarization curves of the nitrogen-alloyed stainless steel layers obtained in Examples 5,6 and high nitrogen P900N stainless steel in deaerated 3.5 wt % NaCl solution at pH 4.
Figure 9:
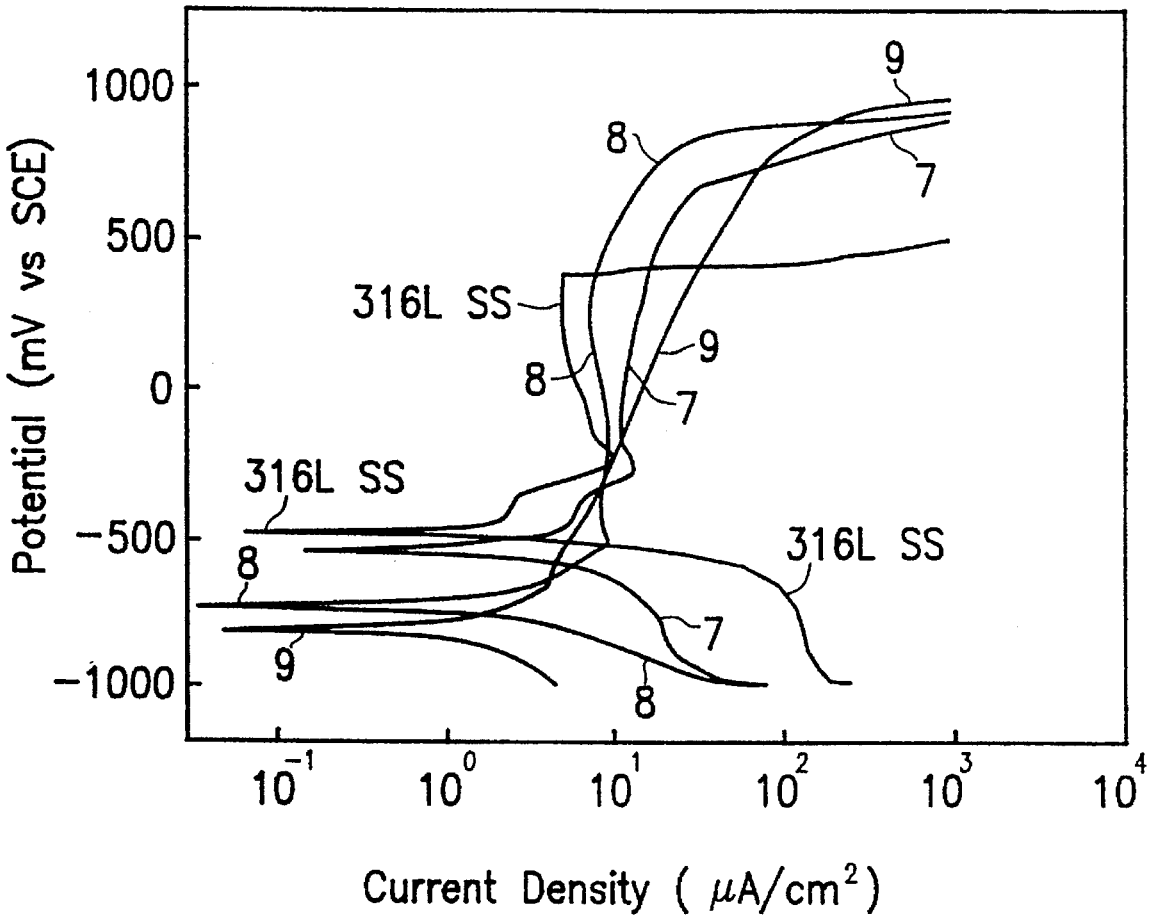
FIG. 9 is a diagram showing the potentiodynamic polarization curves of the nitrogen-alloyed stainless steel layers obtained in Examples 7,8, 9 and austenitic 316 L stainless steel in deaerated 3.5 wt % NaCl solution at pH 4.

Metallographic diagrams of the formed stainless steel layer in Example 2 are shown in FIG. 3 and FIG. 4, in which FIG. 3 is a sectional metallographic diagram, and FIG. 4 is plane metallographic diagram. In FIG. 4, the bright regions indicate austenite, while the dark regions indicate ferrite. As is shown in FIG. 4, the stainless steel layer is rich in austenite, this conforms with the principle that if it is rich in nitrogen, the austenite is increased.

Figure 10:
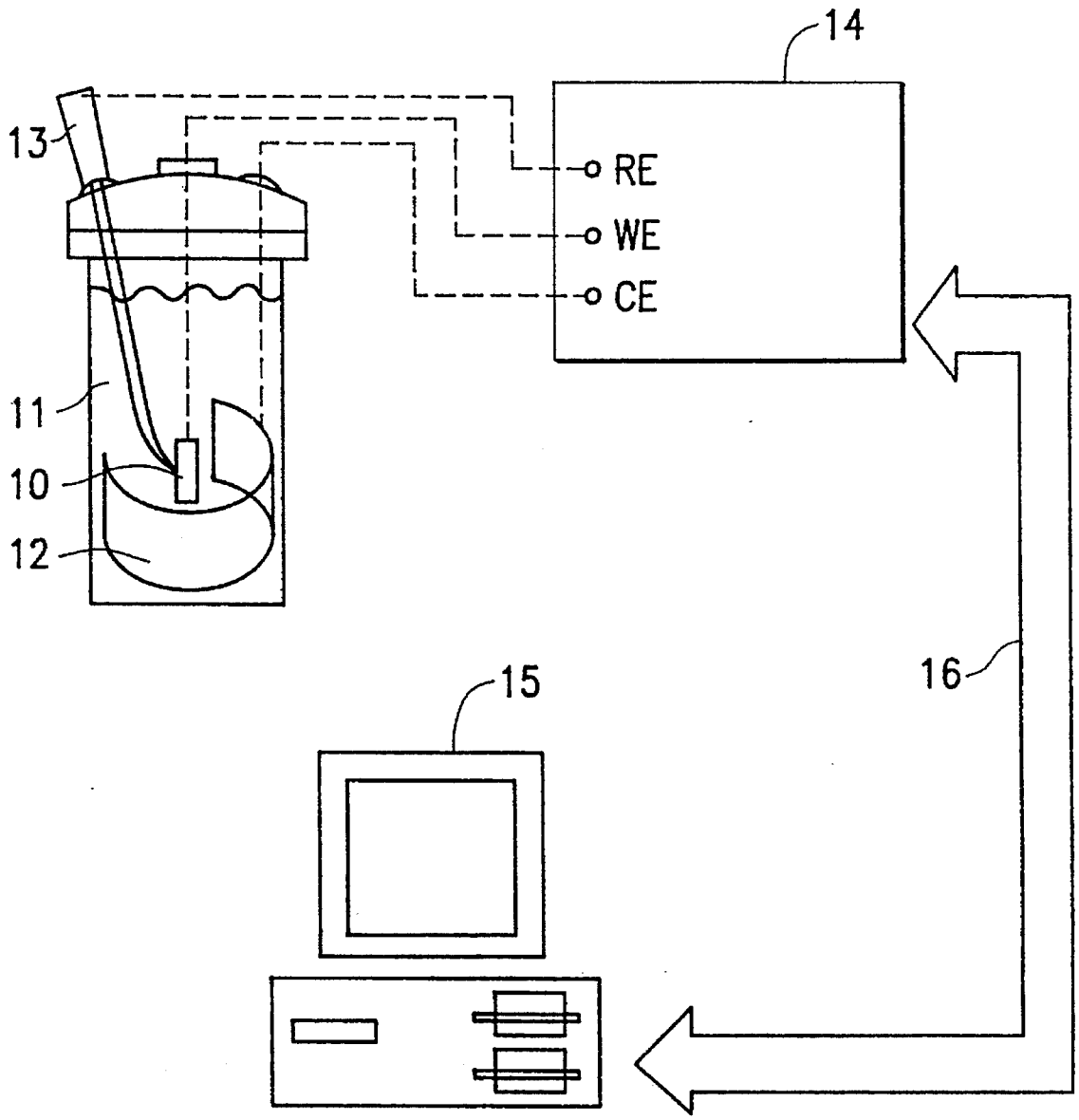
FIG. 10 is a schematic diagram showing the potential meter for measuring the potentiodynamic polarization curves.

The corrosion behavior of the stainless steel layers formed by the process of the invention was evaluated by the potentiodynamic polarization tests. The potentiodynamic polarization curves of the nitrogen-alloyed stainless steel layers of Example 1, 3, 4 and a SAF 2205 ferritic and austenitic dual phase stainless steel, nitrogen-alloyed stainless steel layer of Example 2 and a ferritic 430 stainless steel, nitrogen-alloyed stainless steel layers of Examples 5, 6 and a P900N high nitrogen stainless steel, nitrogen-alloyed stainless steel layers and an austenitic 316 L stainless steel, in deaerated neutral or acid 3.5 wt % NaCl solution were measured and respectively shown in FIG. 6, FIG. 7, FIG. 8 and FIG. 9. These curves were made by using an EG & G Model 273 potential meter shown in FIG. 10. As shown in FIG. 10, specimen 10, a saturated calomel electrode (SCE) 13, a Pt electrode 12 are immersed in a 3.5 wt % NaCl solution 11 and connected to a potentiostat 14 which is connected to a display 15 via IEEE 488 Bus 16. Prior to potential scanning, the potential meter was maintained at an applied potential relative to −1200 mV/SCE for 5 minutes, and then scanned from −1000 mV/SCE to anode at a scanning speed of 1 mV/s.

As shown in these polarization curves, the stainless steel layers formed by the process of the invention have the same level of potential, indicating that the pitting resistance of the formed stainless steel layers is not inferior to that of the known stainless steel. Also, from FIG. 4, it is shown that the adhesion of the stainless steel to the steel substrate is good. Moreover, Table 1 shows that according to the process of the invention, the nitrogen content can be as high as 0.6 wt %, which is higher than the 0.5 wt % level of a normal high nitrogen stainless steel.

What is claimed is:

1. A process for producing a nitrogen-alloyed stainless steel layer on a steel substrate, comprising the following steps:

a) cleaning the surface of the steel substrate by mechanical means;

b) applying a mixed metal powder or a stainless powder to the surface of the steel substrate, wherein the mixed metal powder includes at least iron powder, chromium powder and nitride powder, and the stainless powder includes nitride powder; and c) scanning the surface of the steel substrate with a laser beam so that the heat input generated by the scanning of the laser beam melts the mixed metal powder or the stainless powder including nitride powder, and decomposes the nitride powder into nitrogen and the other element forming the nitride, which then dissolve into the melted mixed metal powder or melted stainless powder, thereby forming the nitrogen-alloyed stainless steel layer on the steel substrate.

2. The process as claimed in claim 1, wherein the steel substrate is a material selected from the group consisting of carbon steel, alloyed steel and special alloyed steel.

3. The process as claimed in claim 1, wherein the nitride is a compound selected from the group consisting of silicon nitride, titanium nitride, aluminum nitride, boron nitride, chromium nitride, and tungsten nitride.

4. The process as claimed in claim 1, wherein the amount of the nitride is from 1 to 3 percent by weight based on the total amount of the mixed metal powder or the stainless powder.

5. The process as claimed in claim 1, wherein prior to step a) a groove having substantially the same size as the surface is formed on the steel, and in step c) the mixed metal powder or the stainless powder is preplaced in the groove.

6. The process as claimed in claim 1, wherein in step c) the scanning of the surface of the steel substrate with laser beam is conducted in a shielding gas.

7. The process as claimed in claim 6, wherein the shielding gas is argon or nitrogen.

8. The process as claimed in claim 1, wherein in step a) the cleaning of the surface of the steel substrate is conducted by sandblasting.

9. The process as claimed in claim 1, wherein in step c) the laser beam is a $CO_2$ laser beam.

10. The process as claimed in claim 1, wherein in step c) the obtained nitrogen-alloyed stainless steel layer contains 0.35 to 0.60 percent by weight of nitrogen.

11. The process as claimed in claim 1, wherein in step c) the obtained nitrogen-alloyed stainless steel layer contains 20 to 47 percent by weight of chromium, 4 to 6 percent by weight of molybdenum and 12 to 21 percent by weight of nickel.

12. The process as claimed in claim 1, wherein in step c) the obtained nitrogen-alloyed stainless steel layer has a thickness of 0.3 to 1.0 mm.

* * * * *